United States Patent [19]

Pouyer

[11] Patent Number: 4,889,444

[45] Date of Patent: Dec. 26, 1989

[54] METHOD AND APPARATUS FOR CONSTRUCTION OF ARTIFICIAL ROADS

[76] Inventor: Joseph E. Pouyer, 13928 Aston, Houston, Tex. 77040

[21] Appl. No.: 195,371

[22] Filed: May 12, 1988

Related U.S. Application Data

[63] Continuation-in-part of Ser. No. 161,780, Feb. 29, 1988, abandoned.

[51] Int. Cl.[4] ..... E01C 5/00

[52] U.S. Cl. ..... 404/34; 404/36

[58] Field of Search ..... 404/34–36, 404/40, 41, 45, 46; 52/581; 108/53.1, 53.3, 53.5, 57.1; 238/10 R

[56] References Cited

U.S. PATENT DOCUMENTS

| | | | |
|---|---|---|---|
| 1,970,037 | 8/1934 | Fischer | 404/46 X |
| 2,450,432 | 10/1948 | Lehrman | 108/57.1 |
| 2,639,650 | 5/1953 | Robishaw | 404/35 |
| 2,652,753 | 9/1953 | Smith | 404/41 |
| 2,819,026 | 1/1958 | Leyendecker | 404/41 X |
| 2,912,909 | 11/1959 | Hart | 404/36 |
| 2,950,078 | 8/1960 | Phillips | 108/53.1 |
| 3,855,945 | 12/1974 | Sebilleau et al. | 108/57.2 |
| 4,184,435 | 1/1980 | Shevchenko | 108/57.1 |
| 4,289,420 | 9/1981 | Davis et al. | 52/581 X |
| 4,462,712 | 7/1984 | Penland, Sr. | 404/46 X |
| 4,600,336 | 7/1986 | Waller, Jr. | 404/46 X |
| 4,600,337 | 7/1986 | Sarver | 404/46 X |

FOREIGN PATENT DOCUMENTS

| | | | |
|---|---|---|---|
| 154227 | 3/1982 | Fed. Rep. of Germany | 404/34 |
| 1579271 | 8/1969 | France | 404/34 |
| 996603 | 2/1983 | U.S.S.R. | 404/35 |
| 998636 | 2/1983 | U.S.S.R. | 404/35 |
| 1198139 | 12/1985 | U.S.S.R. | 404/35 |

*Primary Examiner*—Jerome W. Massie, IV
*Assistant Examiner*—Gay Ann Spahn
*Attorney, Agent, or Firm*—Guy E. Matthews

[57] ABSTRACT

A temporary road is provided which includes a plurality of sets each defined by a first and second matrices which include an upper surface for supporting heavy vehicles and the like over rough or impassable terrain and a second matrices which comprises support members for the upper or first matrices. Thus, one set is laid down such that the first matrices is in a top or upper position and cross members of the second matrices support the top member or upper matrices and thereafter a second set is positioned such that the first matrices is on the ground or in mud or the impassable surface is such that the second matrices or bottom of the second set with its spaced cross-support members interlocks with the spaced cross-support members of the first set and thereafter each set is interlocked such that the first, third, fifth et sequence provide the upper surface of the road and the second, fourth and sixth et sequence sets provide the support for the upper sets. In this way the road can be constructed longitudinally and/or laterally and can further be constructed so that such road may expand laterally for working areas and the like. In the preferred embodiment the road is constructed of wood but also may be constructed of other suitable, lighter and stronger fibers or combinations of fibers, if desired.

3 Claims, 1 Drawing Sheet

METHOD AND APPARATUS FOR CONSTRUCTION OF ARTIFICIAL ROADS

This application is a continuation-in-part of application Ser. No. 161,780 filed Feb. 29, 1988, abandoned 5/12/88.

BACKGROUND OF THE INVENTION

This invention relates to a new and improved method and apparatus for the construction of artificial roads. In the drilling of oil wells or in the search for hydrocarbons or in construction or repairing of different type devices in remote areas it is very difficult to enable trucks and other heavy equipment to transport the necessary apparatus and equipment to the desired site because of poor ground conditions, for example, if the ground is too wet such trucks and the like cannot traverse a wet ground because they will become stuck. To overcome this problem a complete service industry has grown up which is either a complete temporary road construction crew which will lay down gravel, shale, or the like or board construction crews which will lay down as roads, a whole series of boards. Normally, to construct such a road the boards are anywhere from 10 ft. to 20 ft. long and anywhere from 1½ to 2½ inches thick and from 6 to 8 inches wide and thus not only are very heavy but also require manual manipulation in the form of labor to construct such boards laterally to a width of 8 ft. to 14 ft. and longitudinally sometimes for miles.

Further, while such boards, when laid down, will support heavy trucks, tractors, trailers and other equipment, because of the expense involved yet another labor intensive crew must move back in and, if possible, separate such boards or pull such boards apart. Pulling such boards apart is often difficult because such boards are normally nailed with big heavy penny nails hammered into the boards with axes or sledge hammers.

Thus, such board road construction is not only very labor intensive but is also very dangerous because of the weight and build of the boards and it is also very capital intensive because of the number of board feet involved. Further, it is often difficult to remove such boards, if at all, more than one time and because such boards must be singularly torn apart and grouped together the usable life of such boards is not great when compared to the use/cost involved.

SUMMARY OF THE INVENTION

The purpose of the present invention is to attempt to provide a remedy for the construction of such board roads by providing a prefabricated matt system wherein the board roads not only do not have to be nailed together in the field but are also interlocked such they will not be nailed together and further such board matts can be laid down in interlocking relationship in a much quicker and more economical period of time thus saving labor costs in the laying and dismantling of such board roads.

In addition such board roads may also be expanded or contracted such that the road may be expanded laterally with respect to the width of the artificial road and it is to be understood that such interlocking relationship relative to the matrix system is such that the matrices and matting system may be expanded radially relative to a center area for turnarounds or other working operations that is desired.

DESCRIPTION OF THE PREFERRED EMBODIMENT

Figure 1:
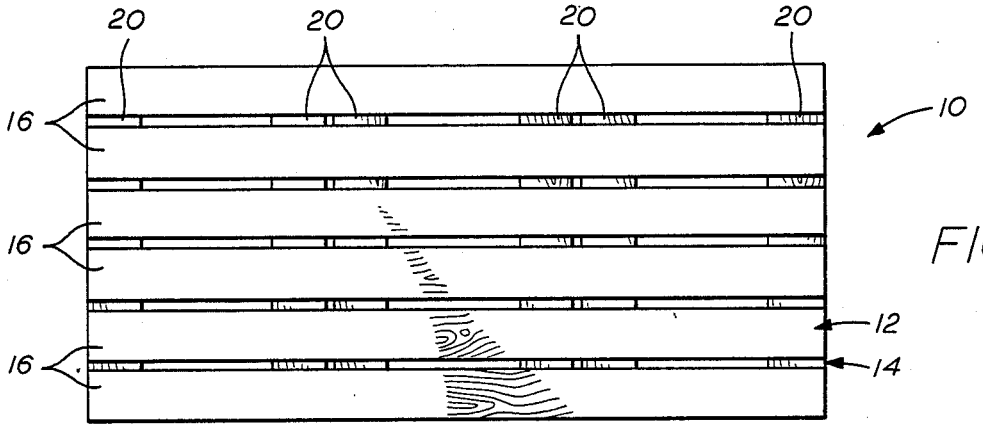
FIG. 1 is a top plan view of one section of the artificial road of the present invention.
Figure 2:
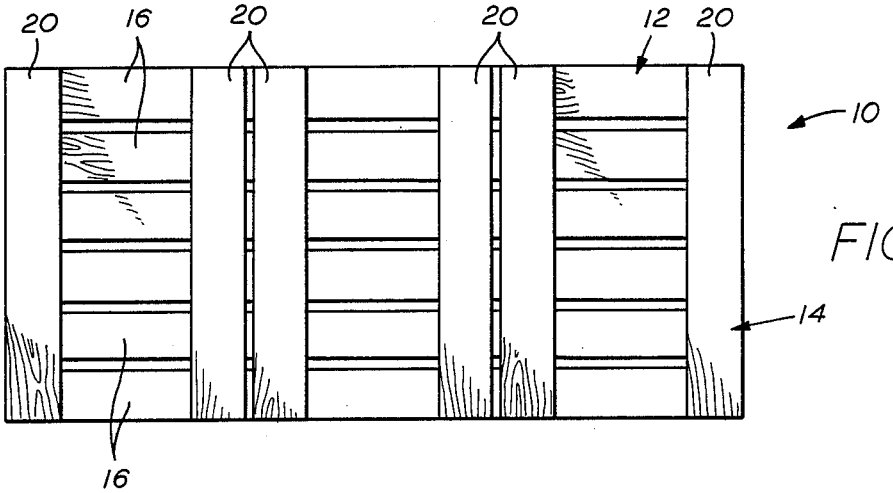
FIG. 2 is a bottom plan view of the artificial road of the present invention.

FIGS. 1–4 set forth in detail the preferred enabling embodiment of the present invention which includes and comprises, as set forth in FIG. 1, a set of 10 boards which comprise an upper matrices generally designated at 12 and a lower matrices generally designated at 14. The upper matrices 12 generally comprises a plurality of boards 16 spaced and of sufficient weight, width and length to support heavy equipment and vehicles because, as set forth hereinabove, such road is positioned and laid down over impassable terrain by such heavy equipment and vehicles. As further set forth in FIGS. 1 and 2, the second or lower matrices 14 is comprised of a plurality of cross-support members 20 for supporting each of the longitudinal members 16. As set forth in FIG. 2 each of the cross support members 20 include at least one of more cross pieces and, as further illustrated, may have more than one cross piece. As further illustrated, each of the cross support members of the second matrices are spaced relative to each other in a manner and for a reason to be set forth in more detail hereinbelow.

Figure 3:
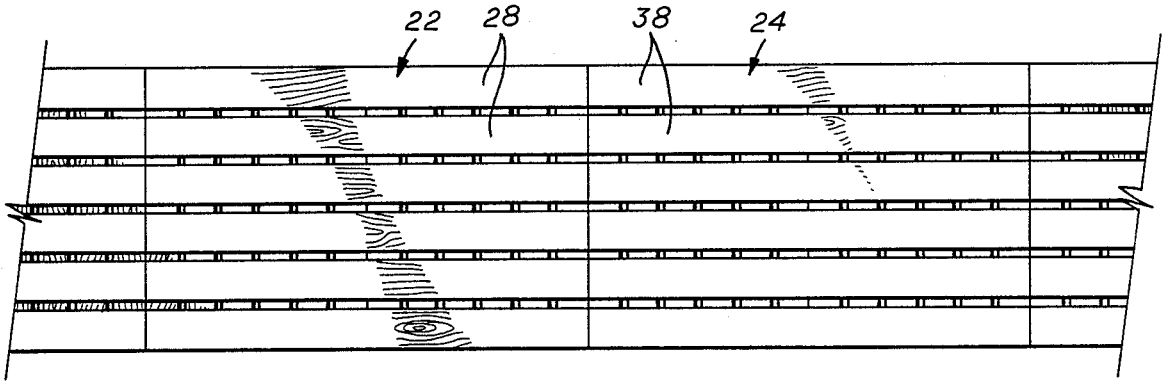
FIG. 3 is a plan view of a series of interlocked sections of this artificial road of the present invention.
Figure 4:
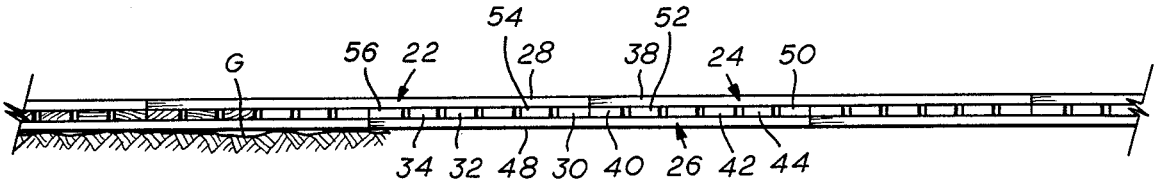
FIG. 4 is a side elevation of a series of interlocked sections of the artificial road of the present invention.

As further illustrated in FIGS. 3 and 4, the method of constructing the temporary road is set forth and generally illustrated by having a first set 22 longitudinally abutting a second set 24 and interlocked by a third set 26. As illustrated, the first set 22 comprises a plurality of longitudinally spaced board members 28 comprising the upper first matrix and a lower surface or second matrix comprising spaced cross pieces 30, 32 and 34. Similarly the second set 24 comprises the first or upper matrices comprising cross pieces 38 for the first or upper matrices and suitable spaced cross pieces 40, 42 and 44. It is to be understood that the second matrices of each of the first and second sets 22 and 24 comprises further and additional cross pieces which interlock with other sets to form the road.

The temporary road further comprises the third set 26 which comprises a first matrices 48 of spaced longitudinally positioned cross pieces and a second matrices which comprises cross pieces for supporting the first matrices which are spaced relative to each other such as illustrated at 50, 52, 54 and 56. As illustrated in FIGS. 3 and 4 and in operation the second set is positioned such that the first matrices cross pieces 26 are laid on the ground G with the second matrices positioned upwardly with the second matrices cross pieces 50 et. sequence being supported and positioned transverse to the first matrices. Thereafter, the first and third sets are laid such that the cross piece 30 and the cross piece 40 of sets 22 and 24 are positioned adjacent each other and adjacent the cross pieces 20 (FIG. 4) of the second matrices of the second set so that such pieces interlock with each other such that any pulling or tugging of the board road in the longitudinal direction of the first matrices of each of such sets will be prevented so that the board road will not separate. In this manner, such temporary board road has a triple stack or set of boards with the second matrices of each of said sets being interlocked relative to each other and with the first matrices of each of said sets either being on the upper or lower surface and being positioned parallel to each other for laying out of the board road and longitudinal directions as desired. It should especially be noted that by providing such interlocking triple stacks both the upper and lower surfaces are comprised of uninterrupted runs of longitudinal boards, each section in the series abuts the adjacent section(s) with no intermediate gaps. This provides a more even transfer of the load from equipment using the road to the surface of the soil. A more even weight distribution over the soil results, this is especially desired in the areas with poor ground conditions where temporary road structures are needed.

Although not illustrated in the primary embodiment depicted in FIGS. 1–4, under some conditions it might be desirable to provide secondary devices for interconnecting the mats. Therefore, although the primary interlocking would be provided by the previously described positioning of cross pieces 40 of sets 22 and 24 adjacent each other and adjacent the cross-pieces 20 (FIG. 4) of the second set, an auxiliary interlocking positioning a guide can be provided by equipping each set 10 with posts and cups which correspond and connect with cups and posts of any other set when sets are correctly positioned and assembled into the road as previously described. Many different configurations could be devised. One example would place posts along the midline underside of the two outer cross-support members 20 depicted in FIG. 2, that is the extreme left and right membrane corresponding cups would be positioned within the underside of the upper boards 16 of FIG. 2. The cups would be placed to align with posts of a similarly equipped set, that is at proper locations just off of the midline of the set, parallel to the cross-support members 20. Each set would be identically equipped with such cups and posts and therefore each set could interchangedly be positioned to interlock with the cups and posts of two other sets. Although only one arrangement has been described, any other arrangement that provides for interchangeable interlocking sets may be used. In addition, the posts and cups could be provided with a bayonet type locking device to further secure the sets together. An alternative to the bayonet type device could be cable securing devices for further securing the sets connected together.

It is to be understood that while such sets have been depicted as being rectangular, that such may be square or radially constructed for radial expansion or may comprise further additions for expanding the road laterally, if desired without departing from the spirit of this invention.

It is to be further understood that while the invention specifically describes in its specific embodiment and enabling disclosure as being constructed of wood boards, that such matrices interlocking road system may be constructed of other type fibers or combination of fibers such as polyurethane, fiberglass, and the like.

It is to be further understood that, as previously mentioned, and in accordance with the spirit of the invention, such sets may be constructed with alternate dimensions and materials for varying applications. The sets could be constructed by way of example and not by way of limitation, of metal or metal alloy, solid or expanded, or a combination of solid channels and expanded metal. Additionally, applications might best be fitted with sets constructed of fiberglass components, or plastic, or rubber, or a combination of these materials.

In particular the components could be manufactured from ground up or pulverized, used automobile and truck tires. This material may be manipulated in a variety of ways to provide the desired strength and durability. The material can be combined with numerous bonding agents, consolidated, and pressed in a mold to form the desired configuration. This material could also be combined with other materials to form composite elements of the recycled tire material and longitudinal fibers in a process analogous to pultrusion for fiberglass or prestressing for precast concrete. Randomly placed shorter fibers can also be provided by simply adding them to the mix with the bonding agent prior to the consolidation and hardening. These random fibers can be added to vary the strength properties of the elements as needed. The curing can be done in a variety of ways, such as by heat, by chemical reaction, or by a combination.

The components of traverse and longitudinal elements can be specifically engineered by designing the composition and placing the corrent type of fibers in the proper location necessary for the stresses each element of the matrices set is subject to. High strength longitudinal fibers such as "Aramid" or Keular can be incorporated into fiberglass sets, as can components formed by a pultrusion process. Such longitudinal fibers or cables could also be used to tie the individual sets together longitudinally. As just discussed, correct placement of the longitudinal cables would add structural strength where needed and further hold sets together as a unit. Laminate composite wood sets can be substituted for the solid timber sets described in the preferred embodiment. Sets could be cast of high strength low density prestressed or post tensioned concrete elements. Elements of any of the above mentioned examples can be combined to meet the longevity, terrain, soil, cost, transportability, and reusability requirements of any particular job requiring a temporary road constructed from interlocking matrices.

While this invention has been described by means of a specific preferred embodiment and various alternative examples it is not to be limited thereto. Obvious modifications will occur to those skilled in the art without departing from the scope of the invention.

What is claimed is:

1. Apparatus for construction of temporary decking and roads for use in areas of poor soil conditions comprising a plurality of substantially identical rectangular units which are placed in two layers, wherein units in different layers are inverted relative to each other, and wherein each unit comprises:

(a) a first rectangular and substantially planar surface;

(b) a second rectangular surface presenting at least four ridges comprising elements arranged transverse to the longitudinal axis of the rectangle, wherein;

(i) first and second transverse elements are each disposed so as to be flush with one of the ends of the unit;

(ii) the remaining transverse elements are approximately twice the width of the first and second transverse elements and wherein said transverse elements are spaced to form at least three similar transverse channels of substantially equal dimensions on the second surface; and, (iii) wherein the first and second transverse ridge elements are approximately half the width of the channels and the remaining transverse elements are approximately the same width as the channels so that transverse elements of any one unit will conform to channels of any other inverted unit, and when units are so interconnected during installation, will substantially prevent longitudinal movement of any unit relative to adjacent units.

2. The invention of claim 1 wherein the first rectangular surface is formed by a first set of longitudinal and substantially parallel timbers, and wherein the transverse elements comprise second and relatively shorter across timbers.

3. A method of constructing a decking system to facilitate transportation over poor soil and rough terrain conditions comprising:

(a) the steps of assembling a plurality of similar rectangular units wherein each of said units is formed by having a first rectangular and substantially planar surface, a second rectangular surface presenting at least four ridges transverse to the longitudinal axis of the rectangle, wherein the first and second transverse elements are flush with the ends of the units, the remaining transverse elements are spaced equidistant to form at least three transverse channels of substantially equal dimensions on the second surface, and wherein the first and second transverse ridge elements are approximately half the width of the remaining transverse ridge elements and the remaining transverse ridge elements are approximately the same width as the channels so that the transverse elements of any one unit will conform to the channels of any other inverted unit so that when units are interconnected as described below the transverse elements substantially prevent longitudinal movement of any unit relative to adjacent units;

(b) laying down a first and third unit with the first planar surfaces adjacent the ground and the second ridged surfaces up, and then placing the second surface of a second unit against the second surfaces of the first and third units so that the first surface of the second unit is up so that the second unit overlaps the first unit substantially, by up to one-half in the longitudinal direction and so that the second unit overlaps the third unit by one-half or more and so that the transverse elements across the second face of the second unit fit into channels within the second face of the first and third units to interlock the second unit with the first and third units to substantially prevent movement in the longitudinal direction;

(c) thereafter laying down an interlocking alternate unit from the third, fifth, seventh, et. seq series and the second, fourth, sixth, et. seq series to extend the decking in longitudinal and lateral directions as desired.

* * * * *